US007650824B2

(12) United States Patent
Ray

(10) Patent No.: US 7,650,824 B2
(45) Date of Patent: Jan. 26, 2010

(54) ADAPTER TO CONVERT ELECTRICAL BOX PUNCH DIES INTO SELF CENTERING PUNCH DIES

(76) Inventor: Brian Ray, 502 E. Houston, Gilbert, AZ (US) 85234

( * ) Notice: Subject to any disclaimer, the term of this patent is extended or adjusted under 35 U.S.C. 154(b) by 288 days.

(21) Appl. No.: 11/552,236

(22) Filed: Oct. 24, 2006

(65) Prior Publication Data

US 2007/0089580 A1 Apr. 26, 2007

Related U.S. Application Data

(60) Provisional application No. 60/730,674, filed on Oct. 26, 2005.

(51) Int. Cl.
*B26F 1/14* (2006.01)

(52) U.S. Cl. ..... 83/684; 83/683; 83/686; 30/66

(58) Field of Classification Search ..... 83/684–686, 83/821, 683, 829, 693, 692, 694, 679, 681, 83/689; 30/360–362, 358, 366
See application file for complete search history.

(56) References Cited

U.S. PATENT DOCUMENTS 3,683,499 A * 8/1972 Robinson, Jr. ..... 30/360
4,844,852 A * 7/1989 Keyser et al. ..... 264/153
5,029,392 A * 7/1991 Bingham et al. ..... 30/360
6,116,133 A * 9/2000 Nishida ..... 83/686
6,435,067 B1 * 8/2002 Irwin ..... 83/228
6,772,667 B2 * 8/2004 Phlipot ..... 83/684
6,973,729 B2 * 12/2005 Nordlin ..... 30/360
7,415,914 B2 * 8/2008 Irwin ..... 83/365

* cited by examiner

*Primary Examiner*—Boyer D Ashley
*Assistant Examiner*—Omar Flores-Sánchez
(74) *Attorney, Agent, or Firm*—Schmeiser, Olsen & Watts LLP

(57) ABSTRACT

This invention generally relates to enlarging a hole in a substrate such that the enlarged hole is centered on the existing hole. A knock-out punch and die tool for enlarging a knock-out hole in an electrical box includes a punch; a generally cup shaped die; a threaded central shaft supporting the punch on one end and the die on the other end; a removable centering element placed in a cup portion of the die; and a resilient element, such as a spring, urging the centering element in an axial direction along a length of the shaft outwardly of the cup portion. The centering element and the spring may be provided as a retrofitting kit for converting non-centering punch and die tools into centering punch and die tools.

2 Claims, 6 Drawing Sheets

ADAPTER TO CONVERT ELECTRICAL BOX PUNCH DIES INTO SELF CENTERING PUNCH DIES

This application claims priority to U.S. Provisional Patent Application Ser. No. 60/730,674 filed Oct. 26, 2005, entitled ADAPTER TO CONVERT ELECTRICAL BOX PUNCH DIES INTO SELF CENTERING PUNCH DIES, by Brian Ray the disclosure of which is incorporated herein by reference.

BACKGROUND OF THE INVENTION

1. Technical Field

This invention generally relates to enlarging a hole in a substrate such that the enlarged hole is centered on the existing hole. Specifically, this invention refers to knock-out dies for enlarging the holes formed by knock-outs or slugs in an electrical box, and to an apparatus and method for centering the enlarged holes relative to the existing knock-out holes.

2. State of the Art

Knock-out dies with centering capability are provided by a centering element integral with the blade or punch of the die. These dies may be used to replace non-centering dies for users that wish to upgrade from their non-centering dies.

DISCLOSURE OF THE INVENTION

In a simple form, the invention may include a knock-out punch and die tool for enlarging a knock-out hole in an electrical box. The punch and die tool may include a punch, a generally cup configured die, and a threaded central shaft supporting the punch on a first end of the shaft and a die on an opposite second end of the shaft. Advantageously, the punch and die tool may further include a repeatably removable centering element received in a cup portion of the die. Furthermore, the punch and die tool may include a resilient element urging the centering element in an axial direction along a length of the shaft outwardly of the cup portion. It is to be understood that the centering element may have a beveled structure that extends radially inwardly toward the shaft in a direction outwardly of the cup portion. The centering element may also have a central through opening surrounding the shaft, and a counter bore of larger diameter than the through opening extending at least a portion of the length of the through opening. The counter bore may thus receive and removably hold a portion of the resilient member. The counter bore may be located within the beveled structure. In another configuration, the counter bore may have a tapered portion and the resilient element may be a spring with a generally tapered shape. In such a configuration, the spring may fit within the centering element when the spring is in the folded or contracted position.

In another simple form, the present invention may include an assembly for a punch and die set. The assembly may include a centering element having a toroid configuration with a central axis perpendicular to a plane of the toroid configuration. The assembly may also include a resilient member removably connected to the centering element. The resilient member may be generally centered relative to the central axis after assembly and during use.

It is to be understood that while only a beveled surface generally tapering toward a point is needed for the centering element, in a particular configuration the toroid configuration may be generally or specifically a quoit configuration.

The assembly may be packaged or otherwise sold as separate pieces or as a kit. In fact, the invention includes a kit having assemblies for a variety of sizes of punches and dies. It is to be understood that the assemblies or kits may be utilized in punch and die tools, even when the punch and die tools do not form part of the kit or assembly.

The present invention may include a method of enlarging a hole in a substrate. In a simple form, the method may include forming a hole centered on an existing hole in the substrate. Forming the hole may be achieved by repeatably removably placing a centering element in a die of a punch and die tool. The method of enlarging the hole may further include placing a resilient element in the die of the punch and die tool. In a particular example, the substrate includes a wall or other surface of an electrical box and the existing hole includes a knock-out hole in the surface of the electrical box.

It is to be understood that the step of removably placing the centering piece may include surrounding a central threaded shaft of the punch and die tool, and the step of placing the resilient member may also include surrounding a central threaded shaft of the punch and die tool. The method may include placing the resilient element between the centering element and a base or bottom of a cup formed in the die.

The method may further include urging the centering element into centering engagement with the existing hole. The centering engagement may be effected by the resilient member and/or by moving the punch and die toward each other. The reaction to the centering engagement may include automatically urging the punch and die into a central position relative to the existing hole in the substrate.

The method may include placing the punch and die tool on the substrate with the shaft extending through the existing hole. The method may specifically include placing the punch on a first side of the substrate and placing the centering element and the die on the other side of the substrate, so that the shaft extends through the existing hole. The method may also include moving the punch toward the die, and thus cutting material of the substrate with a blade of the punch in a centered relation to the existing hole. As may be appreciated, the method may include automatically removing the material cut by the blade by urging the material out of the die. The material may be pushed out of the die by the centering element and resilient element.

In another simple form, the present invention may include a method of converting a non-centering punch and die into a centering punch and die tool. This method may include repeatably removably retrofitting an assembly comprising a toroidal centering element and a resilient element in a cup portion of a die. This method may also include one or more of the method steps described above.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
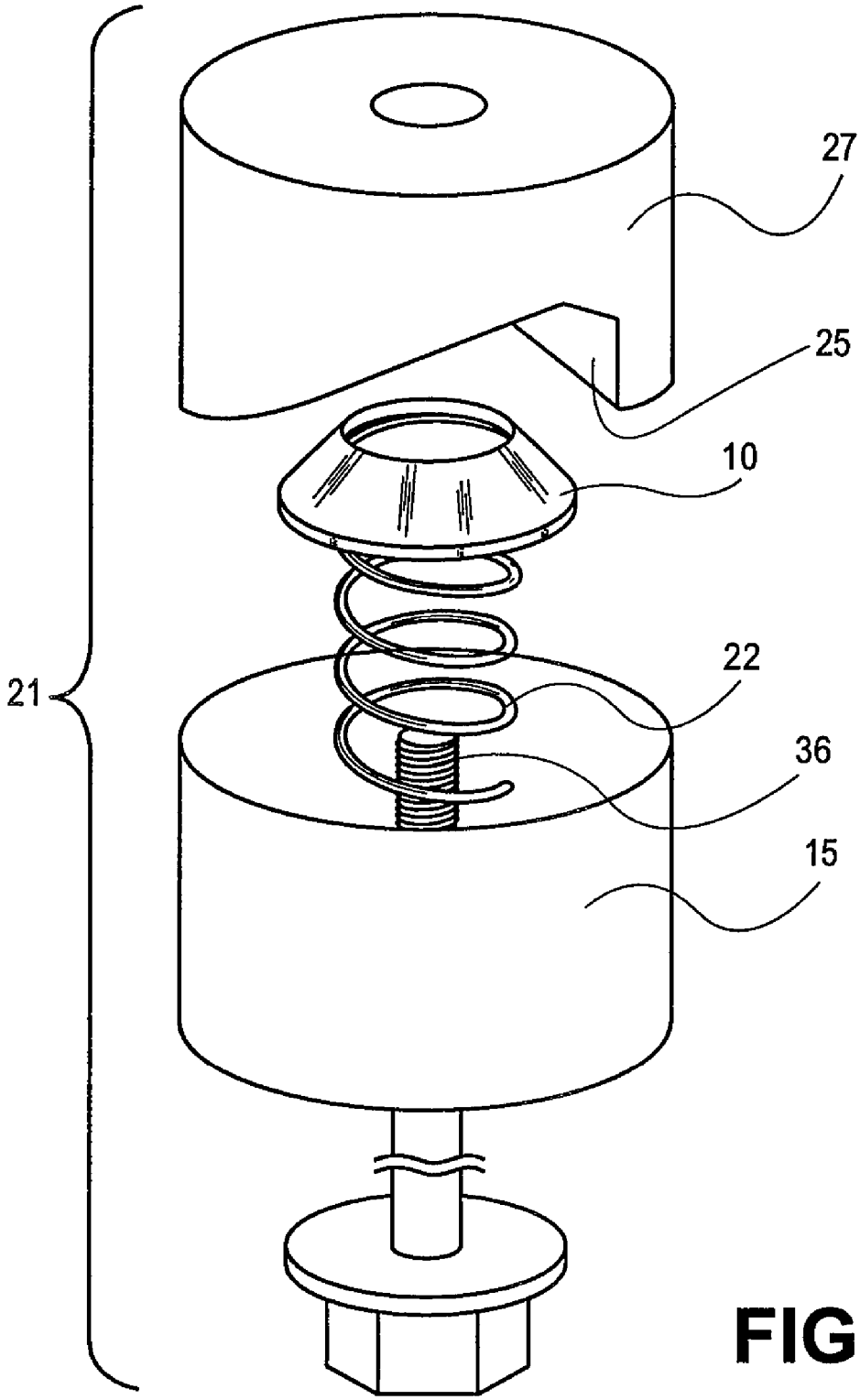
FIG. 1 is an exploded view of a punch and die tool and the centering assembly according to an embodiment of the present invention.
Figure 2:
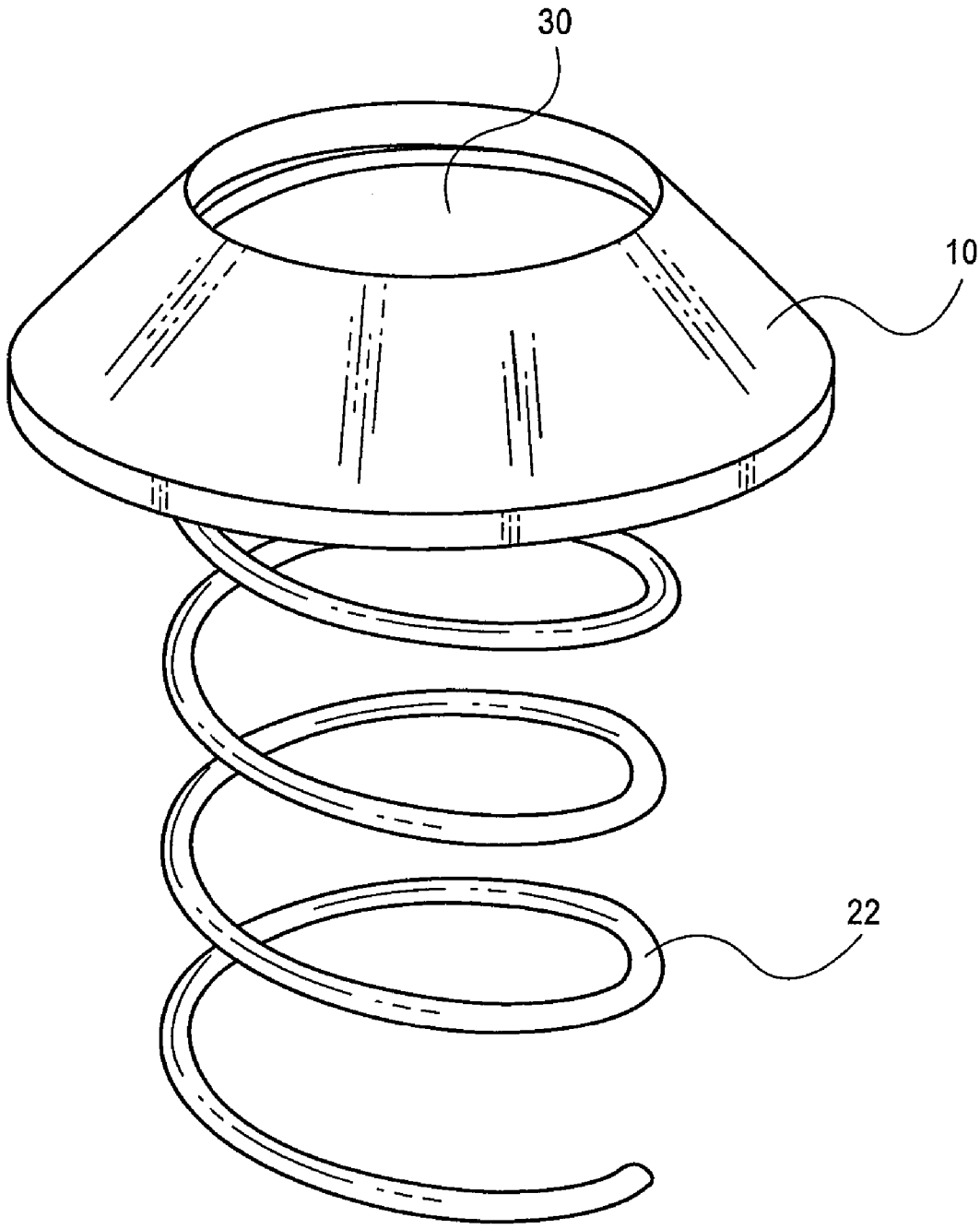
FIG. 2 is a perspective view of a centering assembly according to an embodiment of the present invention.
Figure 3:
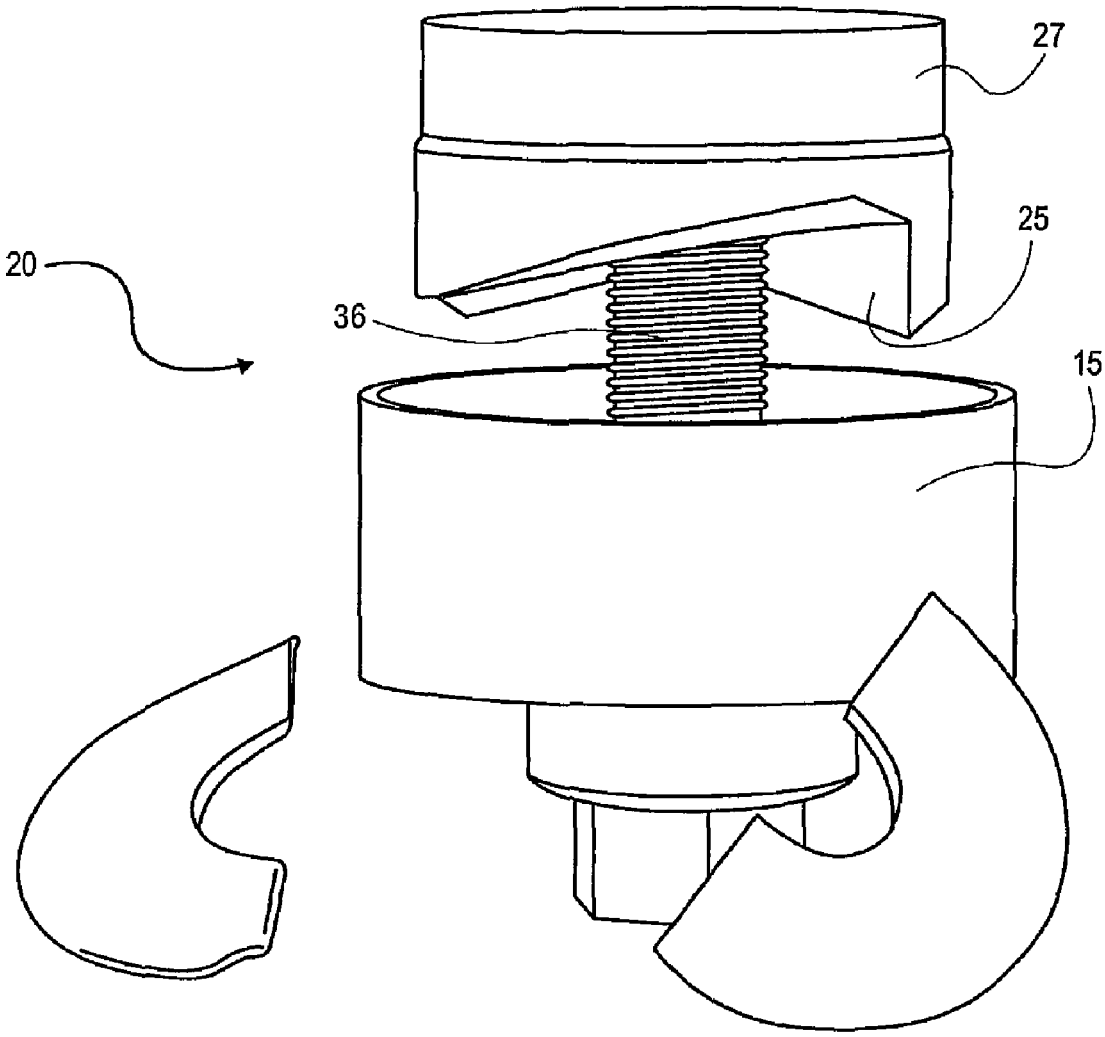
FIG. 3 (PRIOR ART)
FIG. 3 is a perspective view of a prior art punch and die tool with which the assembly of the present invention may be used according to the present invention.

As discussed above, embodiments of the present invention relate to an adapter to convert electrical box punch dies into self centering punch dies. Presently, the invention comprises: a spring loaded centering element or beveled piece 10 that fits in and is biased upwardly out of a die or cup portion 15 of a punch die 21, as shown in FIGS. 1, 2, and 3, by a resilient element or spring 22. In use, the beveled piece 10 engages a knock out or slug opening in a substrate to cause the centering, while the blade 25 of a punch 27 engages the substrate from an opposite side of the substrate relative to the beveled piece 10. The adapter including the beveled piece 10 and the spring 22 can convert a non-centering punch die 20 (shown in FIG. 3) into a centering punch die 21, as shown in FIG. 1. The adapter is repeatably removable so that the centering punch die 21 can be converted back into a non-centering punch die 20 upon removal of the adapter.

Other punch and die manufactures have recently come out with a centering blade that has an integral beveled piece that engages an electrical box wall on a same side as the blade. In this centering device, a beveled element that performs the centering is integral with the blade piece. This requires the consumer to buy a new blade or a whole new punch die if they want the centering feature. On the other hand, with the spring loaded beveled piece of the present invention, conventional non-centering punch dies 20, (See FIG. 3), can be modified to center the punch on an existing slug hole. That is, consumers will not need to buy a new blade or new die. Rather they can buy the adapter of the present invention and retrofit it to their old punch dies. The adapter is repeatably removable so that the non-centering punch die 20 can be converted to a centering punch die 21 using the adapter and can later be used as a non-centering punch die 20 by removing the adapter.

Figure 4A:
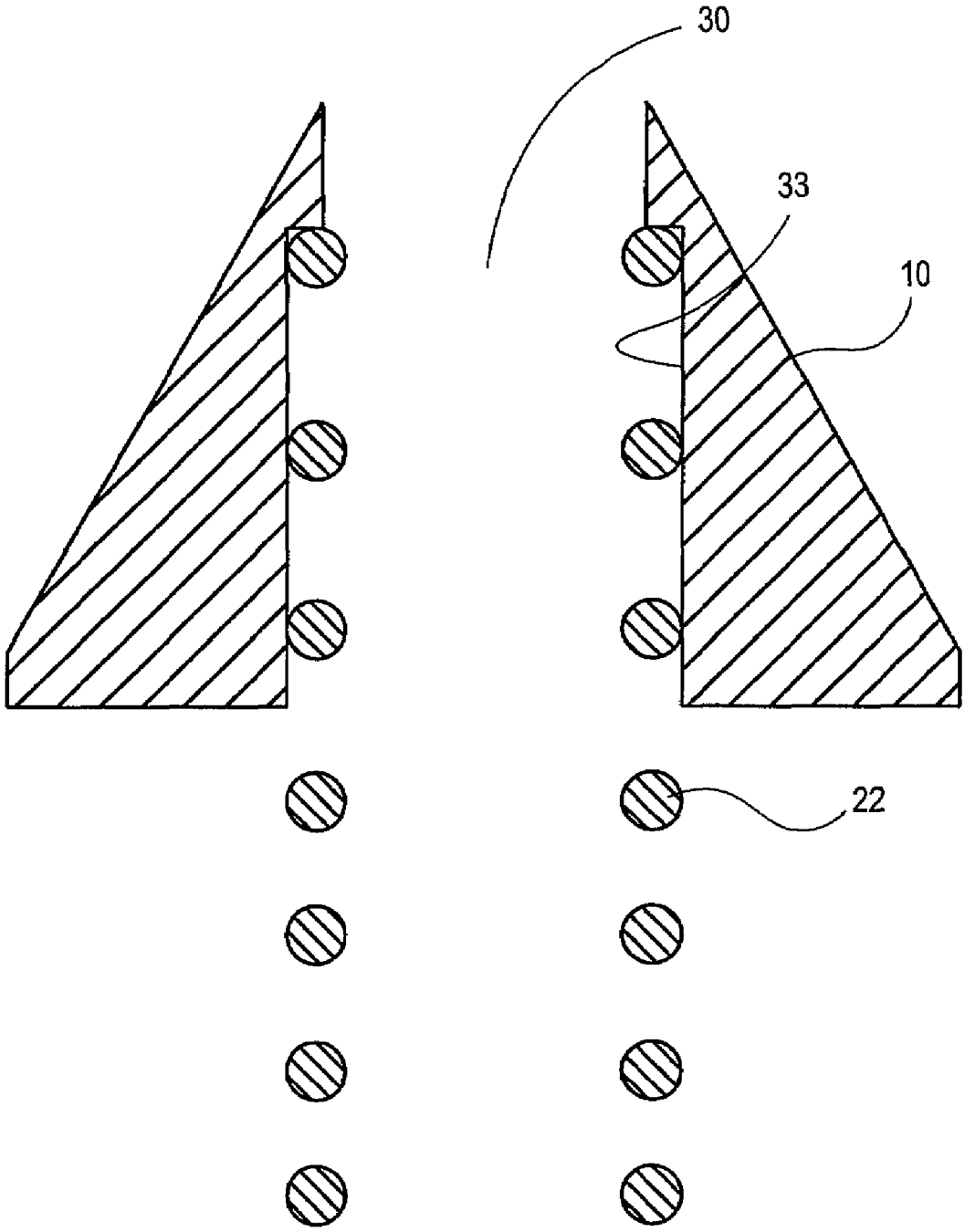
FIGS. 4A and 4B are respective cross-sectional views of the assembly with inner walls that are essentially vertical and inner walls that are partially tapered.

FIG. 4A shows additional details including a through opening 30 and a counter bore 33 that releaseably holds the spring 22. The counter bore 33 has a larger diameter than the through opening 30. The through opening 30 and the counter bore 33 may be located within the beveled surface of the toroidal centering element 10. Other configurations are possible without departing from the spirit and scope of the invention. For example, spring 22 may be replaced by a resilient element that is formed at least in part by an elastomeric material. The beveled surface of the centering element may not be a uniform taper, but may have a rounded or other contoured configuration. The assembly of the centering element 10 and the resilient element 22 may be integral or one piece, and may be pre-assembled or integrally molded, for example.

Figure 4B:
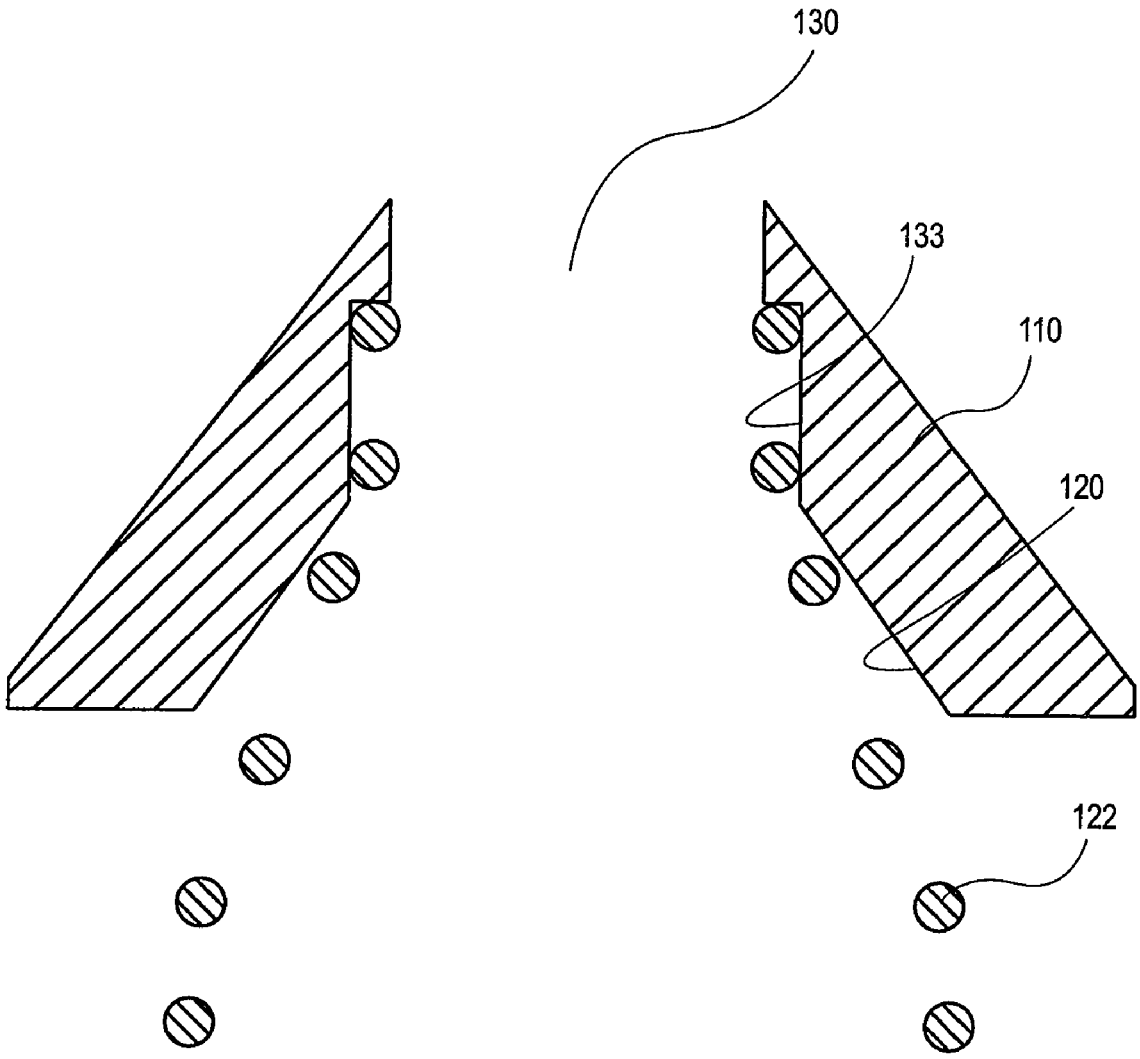

FIG. 4B shows another configuration of the assembly where the centering element 110 may include a tapered portion 120 of the inner sidewall. The counter bore in this configuration may include a vertical portion 133 as well as the tapered portion 120. The through opening 130 and the counter bore including the vertical portion 133 and the tapered portion 120 may be located within the beveled surface of the centering element 110. In this configuration, the spring 122 may have a generally tapered shape so that the spring 122 may fit within the centering element 110 when the spring 122 is in a folded or contracted position. Alternatively, the counter bore may include only a tapered sidewall.

Figure 5:
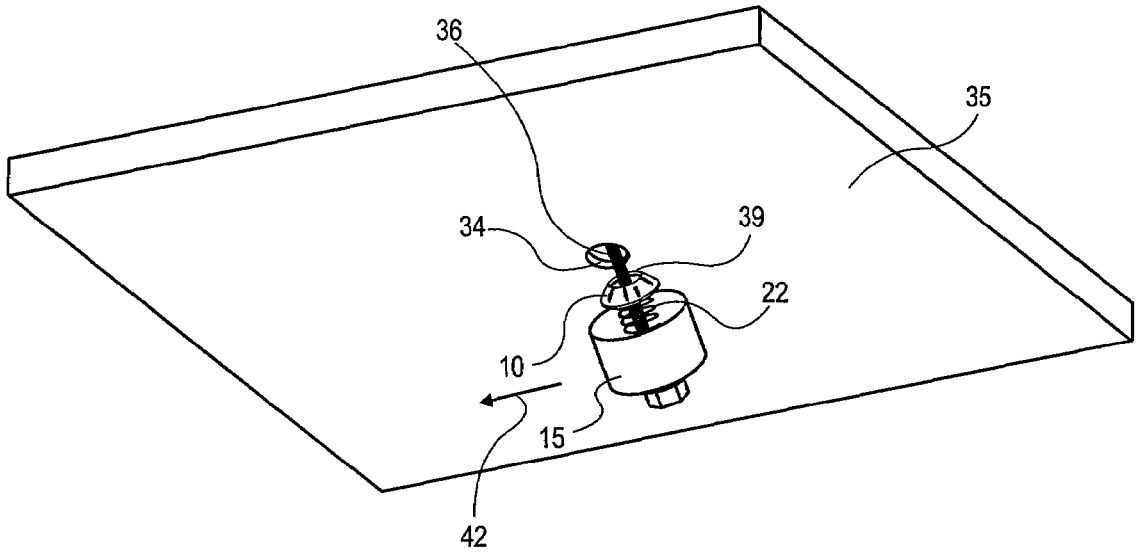
FIG. 5 is a perspective view showing a centering effect in accordance with the present invention.

With regard to FIG. 5, a die tool and centering assembly in accordance with the present invention is shown applied to a knock-out hole 34 in a substrate 35 that may form a wall of an electrical box. In accordance with a method of the present invention, as the shaft 36 is turned in a tightening direction, the die 15 is drawn toward the substrate and the punch, which is on the opposite side of the substrate (not shown in this Figure). The centering element 10 will also be urged into engagement with the substrate 35 and in particular will be engaged in the structure forming the knock-out hole 34. As the centering element engages at a point 39 and is further tightened, for example, the punch and die tool will be urged in a centering direction of arrow 42. Thus, when the punch engages an opposite surface of the substrate 35, it will be centered relative to the hole 34.

The toroidal centering element 10 of the present invention has a maximum diameter smaller than the inner diameter of the cup portion of die 15. The present invention also includes a combination of an electrical box die and a spring loaded beveled piece that has a maximum diameter smaller than an inner diameter of a die cup portion of the die with the beveled piece. This size relationship enables easy placement and removal of the beveled piece 10 and spring 22 in the die. That is, the assembly of the beveled piece 10 and spring 22 may be used as a retrofit assembly or kit. The assembly may be added to or removed from the die as often as desired by the user. Without the assembly, the die is in a non-centering configuration and adding the assembly converts the die to a centering configuration.

The present invention also includes the methods described above including forming holes centered on knock out holes in electrical boxes and which may include steps that are required for inserting the beveled piece and spring into an electrical box die cup.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the present invention.

What is claimed is:

1. A knock out punch and die tool for enlarging a knock out hole in an electrical box comprising:

a punch;

a generally cup shaped die;

a threaded central shaft supporting the punch on a first end of the shaft and the die on an opposite second end of the shaft;

a repeatably removable centering element received in a cup portion of the die; and a resilient element urging the centering element in an axial direction along a length of the shaft outwardly of the cup portion, wherein the centering element comprises:

a beveled structure that extends radially inwardly toward the shaft in a direction outwardly of the cup portion, a central through opening surrounding the shaft and a counter bore receiving a portion of the resilient element, wherein the counter bore is located within the beveled structure, and wherein the counter bore comprises a tapered portion.

2. The punch and die tool of claim 1, wherein the resilient element comprises a generally tapered shape.

* * * * *